US009070362B2

(12) United States Patent
Huang et al.

(10) Patent No.: US 9,070,362 B2
(45) Date of Patent: Jun. 30, 2015

(54) AUDIO QUANTIZATION CODING AND DECODING DEVICE AND METHOD THEREOF

(71) Applicant: Nyquest Corporation Limited, Hsinchu (TW)

(72) Inventors: Shih-Chieh Huang, Hsinchu (TW); Chien-Lung Chen, Hsinchu (TW)

(73) Assignee: NYQUEST CORPORATION LIMITED, Hsinchu (TW)

( * ) Notice: Subject to any disclaimer, the term of this patent is extended or adjusted under 35 U.S.C. 154(b) by 303 days.

(21) Appl. No.: 13/727,489

(22) Filed: Dec. 26, 2012

(65) Prior Publication Data

US 2013/0173261 A1 Jul. 4, 2013

(30) Foreign Application Priority Data

Dec. 30, 2011 (TW) ..... 100150057 A
Dec. 30, 2011 (TW) ..... 100225150 U

(51) Int. Cl.
*G10L 19/12* (2013.01)
*G10L 19/032* (2013.01)
*G10L 19/16* (2013.01)

(52) U.S. Cl.
CPC ..... *G10L 19/032* (2013.01); *G10L 19/167* (2013.01)

(58) Field of Classification Search
CPC ..... G10L 19/00; G10L 19/022; G10L 19/032; G10L 19/035; G10L 19/038; G10L 19/12; G10L 19/16; G10L 19/167
USPC ..... 704/222, 211, 212, 213, 229, 230
See application file for complete search history.

(56) References Cited

U.S. PATENT DOCUMENTS

| | | | | |
|---|---|---|---|---|
| 4,395,593 | A * | 7/1983 | Flanagan | 381/95 |
| 6,804,655 | B2 | 10/2004 | Dokic et al. | |
| 2005/0075869 | A1 | 4/2005 | Gersho et al. | |
| 2010/0318368 | A1 | 12/2010 | Thumpudi et al. | |
| 2011/0099295 | A1 * | 4/2011 | Wegener | 709/247 |

OTHER PUBLICATIONS

Taiwan Patent Office, Office Action, Patent Application U.S. Appl. No. TW100150057, Feb. 7, 2014, Taiwan.

* cited by examiner

*Primary Examiner* — Qi Han
(74) *Attorney, Agent, or Firm* — Rabin & Berdo, P.C.

(57) ABSTRACT

The present disclosure provides an audio quantization coding and decoding device and a method thereof. In the method, before a quantization coding process is performed on a digital signal, the signal is pre-processed, the digital signal is split into multiple frames based on positive and negative half periods of the signal, and all audio data between two adjacent zero-crossing points belongs to the same positive and negative half periods, so as to have the same sign-bit. A pre-processing module groups the numeric data belonging to the same positive and negative half periods into the same frame. When coding, an audio quantization coding module only needs to record a sign-bit of the frame at a head of the frame, so the sign-bit of each batch of voice data in the frame may be omitted to reduce a data amount or improve a resolution of each batch of voice data.

19 Claims, 16 Drawing Sheets

AUDIO QUANTIZATION CODING AND DECODING DEVICE AND METHOD THEREOF

CROSS-REFERENCES TO RELATED APPLICATIONS

This non-provisional application claims priority under 35 U.S.C. §119(a) on Patent Application No. 100150057 and 100225150, both filed in Taiwan, R.O.C. on 2011 Dec. 30, the entire contents of which are hereby incorporated by reference.

BACKGROUND OF THE INVENTION

1. Technical Field

The present invention relates to a quantization device, and more particularly to an audio quantization coding and decoding device and a method thereof.

2. Related Art

A voice signal is originally an analogue signal, and after being digitized and compressed, distortion may be generated. Generally, the higher the compression rate is, the larger the signal distortion is, but the lower the required transmission data rate is. Therefore, when the transmission bandwidth is insufficient, under a condition of capable of recognizing talking content, usually a protocol with a higher compression rate may be selected. If the problem of the transmission bandwidth does not exist, usually the G.711 protocol with the smaller signal distortion is a better selection.

Please refer to FIG. 1, which is a voice coding and decoding system diagram of the prior art, which includes: a voice input signal 100, a voice coder 200, a memory 300, a voice decoder 400, and a voice output signal 500. The voice input signal 100 is a real sound, and is an analogue signal. For example, when the input of voice coder 200 is 8 KHz sample rate, mono, 16-bit word length data, the data rate is 128 k bit-per-second (bps). When the voice input signal 100 is input to the voice coder 200, the voice input signal 100 is sampled as a 128 kbps mono digital data, then is compressed and coded, and is stored in the memory 300. The voice coder 200 is a compressor during practical application. In the practical application, sometimes in order to reduce the memory 300 usage, usually the voice data of 16-bit word length is compressed to the data with a lower resolution (for example, 5 bit or 4 bit), and the data is stored in the memory 300, so as to effectively reduce the memory 300 usage. Finally, the voice decoder 400 decodes the compressed data with the lower resolution stored in the memory 300, converts the data to the single track voice data of 16 bit, and converts the data to the voice output signal 500.

Please refer to FIG. 2A, which is a detailed block diagram of the voice coder 200 of the prior art. The voice coder 200 includes an analogue to digital converter 210, a word length converter 220, a quantizer 230, and a data coder 240. The analogue to digital converter 210 receives the analogue voice input signal and converts the analogue voice input signal to the digital first voice data. The word length converter 220 is connected to the analogue to digital converter 210, and performs word length reduction on the first voice data. The quantizer 230 is connected to the word length converter 220, receives the first voice data and performs quantization to generate a digital codeword which includes sign bit and numeric data. The data coder 240 is connected to the quantizer 230, and receives at least one digital codeword to generate an encoded voice data stream.

In another conventional implementation manner, please refer to FIG. 2B, in which an external first memory 110 stores the first voice data, in which the word length converter 220 performs the word length reduction on the first voice data. The quantizer 230 is connected to the word length converter 220, receives the first voice data and performs the quantization to generate a digital codeword which includes the sign bit and the numeric data. The data coder 240 is connected to the quantizer 230, and receives at least one digital codeword to generate an encoded voice data stream.

An example is given in the following.

Please refer to FIG. 3, in which the voice data of 16-bit word length converted by the analogue to digital converter 210 includes 7 batches of first voice data: 1111101100001000, 1111001100001000, 1111111100001000, 0000000100001000, 0000010100001000, 0000100000001000, and 0000111100001000. The word length converter 220 converts the 7 batches of first voice data of 16 bit to the first voice data of 8 bit having negative and positive signs. The word length converter 220 directly removes the $1^{st}$ bit to the $8^{th}$ bit in the first voice data of 16 bit, only the $9^{th}$ to the $16^{th}$ data of the original first voice is retained, and the retained data is the new first voice data. Therefore, the first voice data is finally the data of 8 bit having the positive and negative signs, and a data range is from −128 to 127. The $1^{st}$ bit to the $7^{th}$ bit represent the numeric data (the magnitude of the voice signal), and the $8^{th}$ bit represents the sign bit (the positive or the negative value of the voice signal). Therefore, after the word length converter 220 performs the word length reduction on the first voice data, the 7 new obtained first voice data is 11111011, 11110011, 11111111, 00000010, 00000101, 00001000, and 00001111 (−5, −13, −1, 2, 5, 8, 15).

Next, the quantizer 230 quantizes the first voice data to generate the digital codeword, and the quantization process may be performed by using a table look-up method. Although the voice data may be positive or negative, in order to save the using of the memory, usually only a quantization table of positive value is established. Before the quantization procedure, firstly the sign-bit representing the signal polarity is recorded, then an absolute value is taken from the voice data, and the voice data is quantized by using the positive valued quantization table. In the following, a table of 5 bit is given as an example, the first voice data (−5, −13, −1, 2, 5, 8, 15) is quantized by using the quantization table 1. For example, the sign-bit of the voice data −5, −13, −1 is recorded as 1, but the sign-bit of 2, 5, 8, 15 is recorded as 0, and the absolute value is taken from all the data to obtain (5, 13, 1, 2, 5, 8, 15) in which for 5, an optimal index codeword obtained according to the quantization table 1 is 3, and a corresponding quantization binary index codeword is 00011, and for 13, an optimal index codeword obtained according to the quantization table 1 is 7, and a corresponding quantization binary index codeword is 00111, then the numeric data after the sign-bit is added to the $5^{th}$ bit is respectively 10011 and 10111.

Therefore, for the absolute value of the first voice data (−5, −13, −1, 2, 5, 8, 15), the index codeword obtained according to Table 1 is (3, 7, 1, 2, 3, 4, 7) under the minimum absolute error criterion. The corresponding binary digital codeword is (00011, 00111, 00001, 00010, 00011, 00100, 00111) and the binary digital codeword after the sign-bit is replaced at the $5^{th}$ bit is (10011, 10111, 10001, 00010, 00011, 00100, 00111).

TABLE 1

| Binary index codeword | Index codeword | Quantization table |
|---|---|---|
| 00000 | 0 | 0 |
| 00001 | 1 | 1 |
| 00010 | 2 | 2 |
| 00011 | 3 | 5 |
| 00100 | 4 | 8 |
| 00101 | 5 | 9 |
| 00110 | 6 | 10 |
| 00111 | 7 | 15 |
| 01000 | 8 | 30 |
| 01001 | 9 | 40 |
| 01010 | 10 | 45 |
| 01011 | 11 | 50 |
| 01100 | 12 | 55 |
| 01101 | 13 | 60 |
| 01110 | 14 | 90 |
| 01111 | 15 | 100 |
| 11111 | 31 | Frame switch control code |

During the practical application, in order to reduce the quantization error, usually multiple quantization tables are used for different dynamic ranges. Please refer to FIG. 4, in which the digital code 600 is formed by the sign bit 612 and the numeric data 614. The encoded voice data stream is formed by multiple digital codewords, and 7 batches of the digital code 600 has a data amount of totally 35 bit. The encoded voice data stream usually also includes frame header 606. The frame header 606 records the index of the optimal quantization table corresponding to the current frame, and the frame switch control code (usually a unique non-used codeword is adopted). The data length of the frame header 606 is determined according to the number of the quantization tables, for example, when 8 quantization tables are adopted, the frame header 606 needs 3 bits to represent the index of the optimal quantization table, and when 32 quantization tables are adopted, the frame header 606 needs 5 bits to represent the index of the optimal quantization table. Taking the length of the frame header being 10 bits as an example (frame switch control code of 5 bits plus index of the optimal quantization table of 5 bits), the length of the tandem voice data is 35+10=45 bits after being coded. Therefore, the original 7 batches of the first voice data of 16 bits have a total of 112 bits, and the word length converter 220 converts the 7 batches of data of 16 bits to only 7 batches of first voice data of 8 bits totally having 56 bits. Then, by using a quantization result of the quantizer 230, each batch of data of 8 bits (table code), is changed to the index codeword data of 5-bit, and finally the data amount of the 7 batches of 5-bit data is 35 bits. It may be known that the original data amount of 112 bits is reduced to 35 bits through the word length converter 220 and the quantizer 230. Afterwards, the frame header 606 of 10 bit is added, and the final data amount is 45 bit.

From the above prior art, during the voice quantization process, each quantized digital codeword has the sign bit and the numeric data. It is a waste for each digital codeword to include the sign bit. Therefore, in order to reduce the waste of the data storage, it is necessary to provide a new architecture.

SUMMARY

The present disclosure provides an audio quantization coding device, wherein a memory is used as the storage medium to perform signal coding. The memory records a plurality of first voice data, the device including: a signal splitter, a quantizer and a data coder. The signal splitter reads the plurality of first voice data and performing a plurality of times of zero-crossing condition checking to generate a plurality of first sign bit in sequence, and splitting the plurality of first voice data into a plurality of frames. The quantizer is connected to the signal splitter, receiving the plurality of first voice data and the first sign bit corresponding to each frame, quantizing the plurality of first voice data corresponding to the frame received each time to generate a plurality of first numeric data, and correspondingly generating a first frame header according to a frame quantization result. The data coder is connected to the quantizer and the signal splitter, receiving the plurality of first numeric data, the first sign bit, and the first frame header generated by the quantizer for each frame, and performing coding to form a first encoded data stream.

The present disclosure also provides the corresponding audio quantization decoding device, wherein a memory is used as the storage medium to perform signal decoding, the memory records a second encoded data stream, the device including: a data decoder and a dequantizer. The data decoder is connected to the memory, reading the second encoded data stream and performing data decoding to generate a plurality of second decoded data stream, wherein each second decoded data stream includes a second frame header, a second sign bit, and a plurality of second numeric data. The dequantizer is connected to the data decoder, receiving the second decoded data stream, and dequantizing the plurality of second numeric data according to values of the second frame header and the second sign bit to generate a plurality of second voice data in sequence.

The present disclosure also provides an audio quantization coding method, used for the coding of digital signal, and including: reading a plurality of first voice data and performing a plurality of times of zero-crossing condition checking to generate a plurality of first sign bit in sequence, and splitting the first voice data into a plurality of frames; receiving the multiple first voice data and the first sign bit corresponding to each frame, quantizing the first voice data corresponding to the frame received each time to correspondingly generate a plurality of first numeric data, and correspondingly generating a first frame header according to each frame quantization result; and receiving the first numeric data, the first sign bit, and the first frame header, and performing the coding process to form a first encoded data stream.

The present disclosure further provides an audio quantization decoding method, used for decoding digital voice data, and including: reading a second encoded data stream and performing the coding process to generate a plurality of second decoded data stream, in which each second decoded data stream includes: a second frame header, a second sign bit, and a plurality of second numeric data; and receiving the second decoded data stream, and dequantizing the second numeric data according to values of the second frame header and the second sign bit to generate a plurality of second voice data in sequence.

The present disclosure further provides an audio quantization and dequantization method, including: reading first voice data and performing a plurality of times of zero-crossing condition checking to generate a plurality of first sign bit in sequence, and splitting the first voice data into a plurality of frames; receiving the multiple first voice data and the first sign bit corresponding to each frame, quantizing the first voice data corresponding to the frame received each time to generate a plurality of first numeric data, and correspondingly generating a first frame header according to a frame quantization result; receiving the first numeric data, the first sign bit, and the first frame header, and performing coding to form a first encoded data stream; reading a second encoded data stream and performing decoding to generate a plurality of second decoded data stream, in which each second decoded data stream includes: a second frame header, a second sign bit, and a plurality of second numeric data; and receiving the second decoded data stream, and dequantizing the second numeric data according to values of the second frame header and the second sign bit to generate a plurality of second voice data in sequence.

The present disclosure provides a more efficient coding device. In an existing coding device, each quantized codeword includes a sign bit, so that the stored data amount is virtually wasted. The present disclosure provides a method that only one sign bit is used, and a plurality of numeric data is serially connected to form a frame data. The data storage may be reduced while maintaining the resolution. On the other way, the sound quality can be significantly improved by slightly increasing the data storage.

In order to make the aforementioned and other objectives, features and advantages of the present disclosure comprehensible, preferred embodiments accompanied with figures are described in detail below.

BRIEF DESCRIPTION OF THE DRAWINGS

The present disclosure will become more fully understood from the detailed description given herein below for illustration only, and thus not limitative of the present disclosure, wherein.

DETAILED DESCRIPTION

Figure 5A:
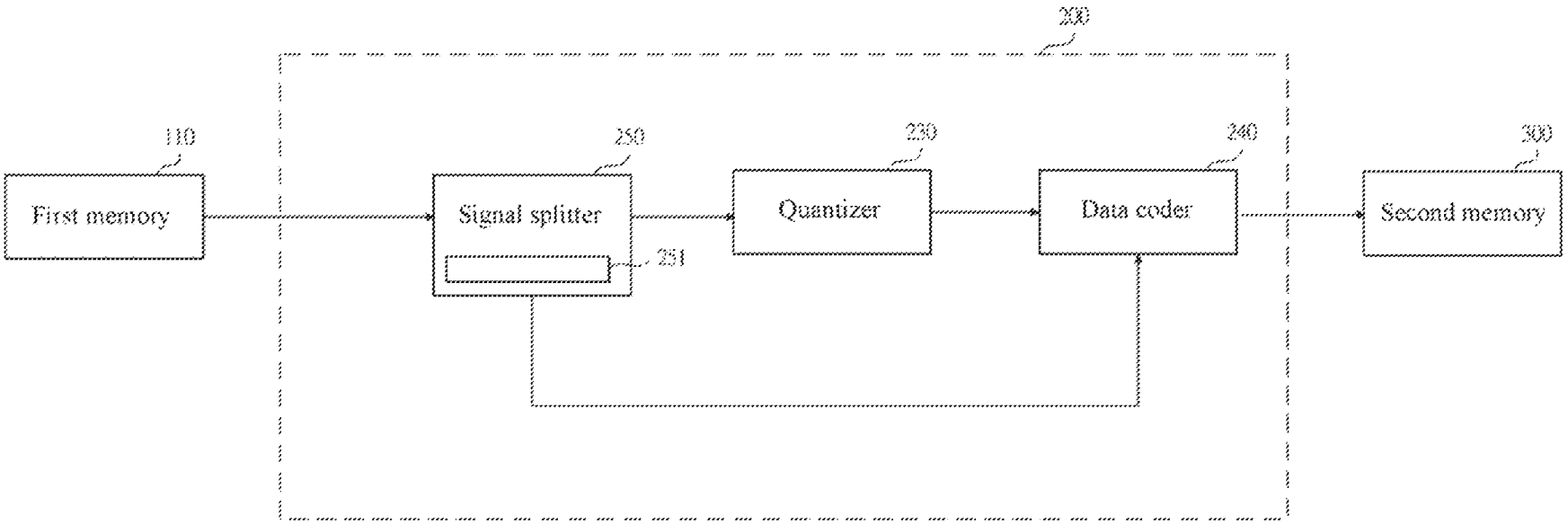
FIG. 5A shows a first embodiment of a functional block diagram of a voice coder according to the present disclosure.

Please refer to FIG. 5A, which shows an embodiment of an audio quantization coding module 200A according to the present disclosure. The audio quantization coding module 200A includes a quantizer 230, a signal splitter 250, and a data coder 240. The signal splitter 250 includes a register 251, and the signal splitter 250 reads stored first voice data from a first memory 110, performs zero-crossing condition checking to generate a plurality of first sign bit 612 in sequence, and splits the first voice data into a plurality of frames. The quantizer 230 is connected to the signal splitter 250, quantizes the multiple first voice data corresponding to the frame in sequence according to the multiple first voice data and the first sign bit corresponding to the frame split by the signal splitter 250, then correspondingly generates a first numeric data in a one to one manner, and generates a first frame header 606 according to a frame quantization result. The data coder 240 is connected to the quantizer 230 and the signal splitter 250, receives the first numeric data, the first sign bit, and the frame header, and performs coding to form a first encoded data stream, in which each first encoded data stream includes the first frame header, the first sign bit, and the multiple first numeric data. Then, the first encoded data stream is stored in a second memory 300.

Practically, the first memory 110 and the second memory 300 may be different blocks in the same memory.

Figure 5B:
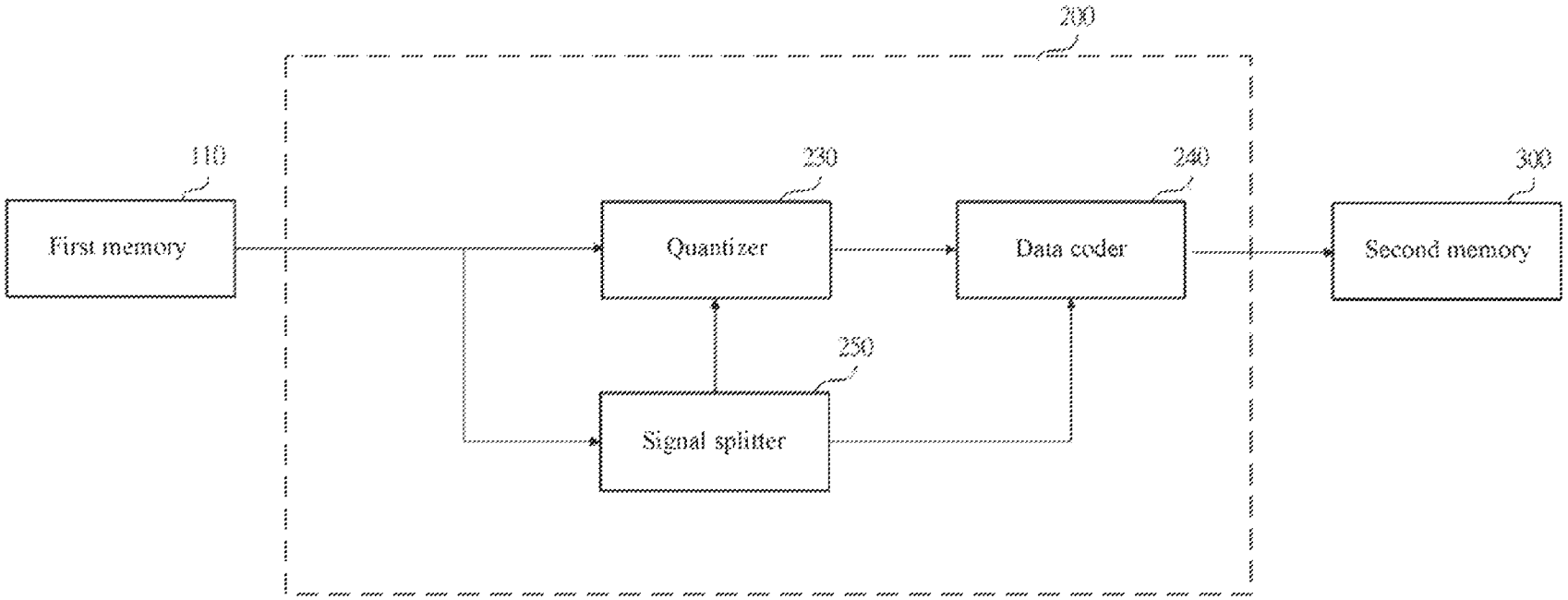
FIG. 5B shows a second embodiment of a functional block diagram of a voice coder according to the present disclosure.

Please refer to FIG. 5B, which shows an embodiment of an audio quantization coding module 200B according to the present disclosure. The main difference between FIG. 5B and FIG. 5A is that the multiple first voice data corresponding to the frame read by the quantizer 230 in FIG. 5B is directly read from the first memory 110 and is quantized. In FIG. 5A, the multiple first voice data for the quantizer 230 is firstly read from the first memory 110, then is placed in the register 251 of the signal splitter 250. The quantizer 230 reads the multiple first voice data from the register 251 of the signal splitter 250 and performs the quantization process.

Figure 6A:
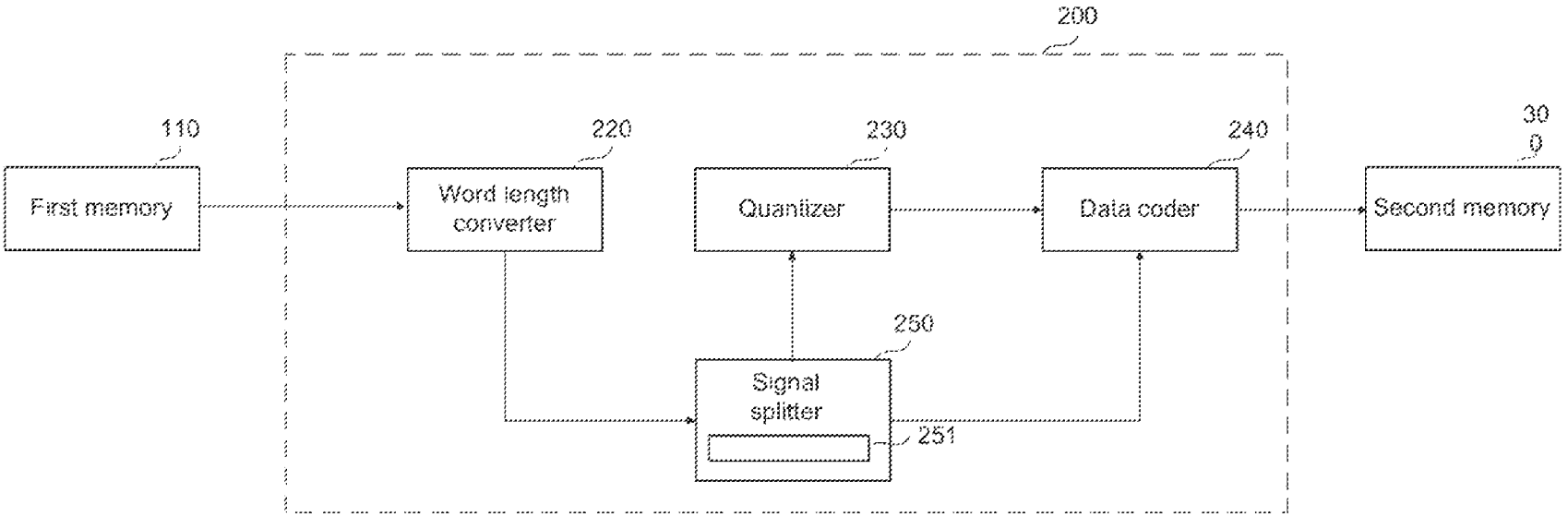
FIG. 6A shows a third embodiment of a functional block diagram of a voice coder according to the present disclosure.

Please refer to FIG. 6A, which shows an embodiment of an audio quantization coding module 200C according to the present disclosure. Compared with the embodiment of FIG. 5A, a word length converter 220 is added. The word length converter 220, connected between the first memory 110 and the signal splitter 250, performs the word length reduction on all the first voice data in the first memory 110, and then stores the reduced first voice data in the register 251.

Figure 6B:
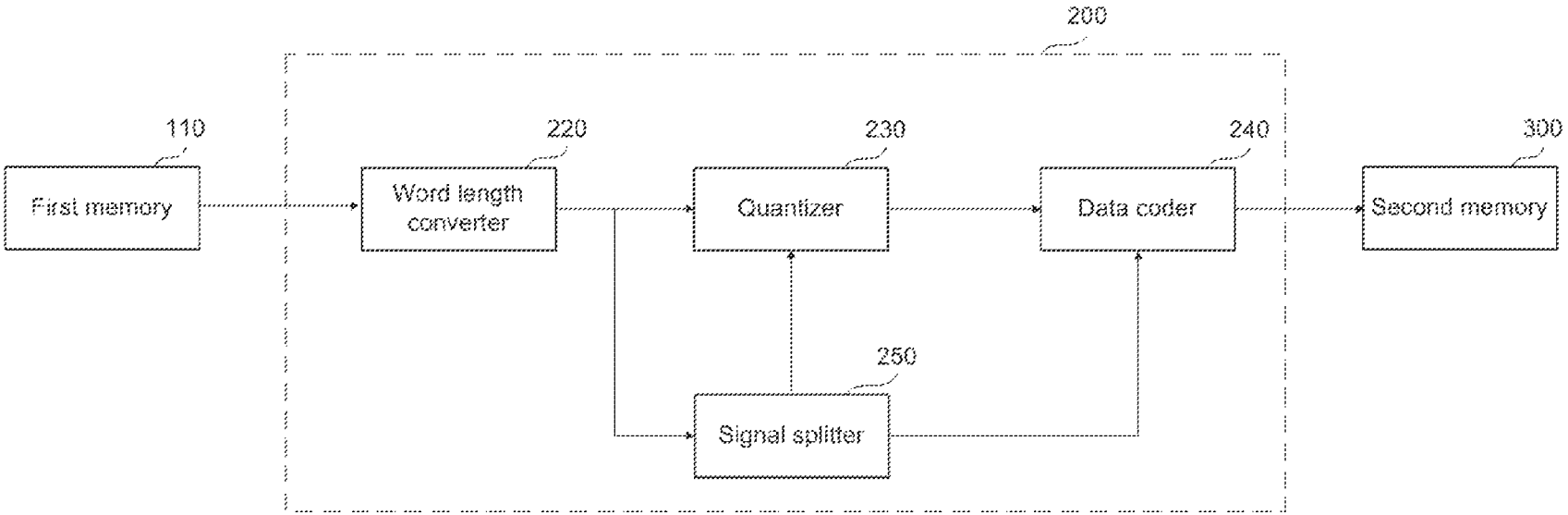
FIG. 6B shows a fourth embodiment of a functional block diagram of a voice coder according to the present disclosure.

Please refer to FIG. 6B, which shows an embodiment of an audio quantization coding module 200D according to the present disclosure. Compared with the embodiment of FIG. 5B, a word length converter 220 is added. The word length converter 220 is connected among the first memory 110, the signal splitter 250, and the quantizer 230. It performs the word length reduction on the first voice data stored in the first memory 110, and then transmits the reduced first voice data to the quantizer 230.

The quantizer 230 includes a control unit and a vector unit. The control unit calculates the total quantization error of all the first voice data or the word length reduced first voice data in each frame and selects the optimal quantization table with minimum quantization error. The optimal quantization table index is put in the frame header. The vector unit receives the first voice data, performs look-up of the selected quantization table, and correspondingly generates the quantized numeric data.

The word length converter 220 according to the present disclosure is not limited that 16 bits is reduced to 8 bits, 16 bits may be changed to 10 bits, or 24 bits is reduced to 12 bits, which is not limited in the present disclosure, and is selected according to system design.

The first voice data may be the data after the word length reduction, for example, 16 bits is changed to 8 bits or 10 bits. In some embodiments of the present disclosure, the first voice data after the splitter forms data frames of the same signal polarity. The multiple first voice data in the same frame have the same sign bit, the sign bit representing positive and negative signs in the digital code 600 is omitted and integrated in the frame header, a new numeric data 614 is formed, which only includes content representing the magnitude of a sound data, but does not include positive and negative information, referring to FIG. 7. In this manner, the bit number of the digital code 600 in the prior art may be reduced. For example, 5 bits per data can reduced to 4 bits per data, so as to reduce the data storage while maintaining the same sound quality. Alternatively, if the data word length of the digital code 600 keeps 5 bits, the effective data resolution is 5 bits instead of 4 bits of prior art. In the present disclosure, 1 bit resolution is increased when the data word length of the digital code 600 keeps the same, so as to improve the resolution of the coding data.

Figure 7:
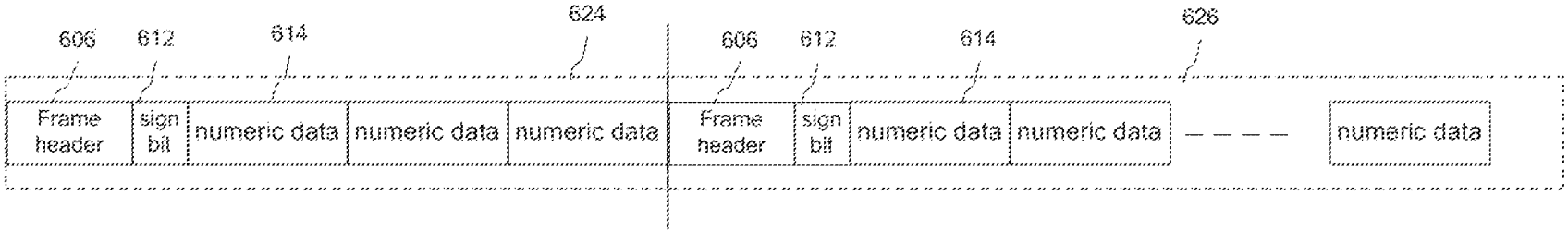
FIG. 7 is a diagram of an embodiment of tandem voice data according to the present disclosure.

Please refer to FIG. 7, which is a schematic view of a data structure of encoded voice data stream according to the present disclosure. Each encoded voice data frame 624 and 626 includes a frame header 606 a sign bit 612, and multiple batches of numeric data 614. In other words, each encoded voice data frame begins at the frame header 606 and ends before the next batch of the frame header 606. The length of each encoded voice data frame 624 and 626 depends on the data count between the two contiguous zero-crossing points, that is, encoded voice data frame size=frame header 606+sign bit 612+data count between the two contiguous zero-crossing points×word length of numeric data (for example, 4 bit or 5 bit). As shown in FIG. 7, the plurality of the numeric data within the same encoded voice data frame 624 have the same polarity (the sign bit 612).

In other words, the positive sign or the negative sign of the sign bit 612 is generated through the zero-crossing condition checking performed by the signal splitter, and the zero-crossing condition checking is performed according to data variation of two contiguous first voice data. When receiving a positive first voice data followed by a negative first voice data or a negative first voice data followed by a positive first voice data, the signal splitter 250 according to the present disclosure may determine that the zero-crossing condition exists, and generate the sign bit 612 to provide the sign information to the data coder 240. The positive sign of the sign bit 612 may be represented by 0, and the negative sign of the sign bit 612 may be represented by 1. For example, the first one of the first voice data is A, the second one of the first voice data is B, when A<0 and B>=0, the signal splitter 250 generates the sign bit 612 being "0" (positive sign), that is, the first voice data is changed from negative to positive, that is, the first voice data occurring subsequently is positive; when A>=0 and B<0, the signal splitter 250 generates the sign bit 612 being "1" (negative sign), that is, the first voice data is changed from positive to negative, that is, the first voice data occurring subsequently is negative. The above-mentioned is only an embodiment of the present disclosure for implementing the zero-crossing condition checking, and the present disclosure is not limited to the manner.

EXAMPLE ONE

This embodiment describes a situation that the word length of the numeric data representing the voice signal is fixed to be 4 bit. Two or more quantization tables corresponding to the frame header 606 may exist. Thus the frame header 606 must adopt at least one bit to indicate which table is adopted. For example, when only two quantization tables are used, for the frame header 606, a table value corresponding to Table 2 (the first table of this embodiment), is "0", and a table value of Table 3 (the second table of this embodiment) may be set to "1. When five quantization tables are adopted, the frame header 606 needs 3 bits, and respectively corresponding table values are 000, 001, 010, 011, and 100. The number of quantization tables corresponding to the present disclosure may be one or multiple.

Figure 1:
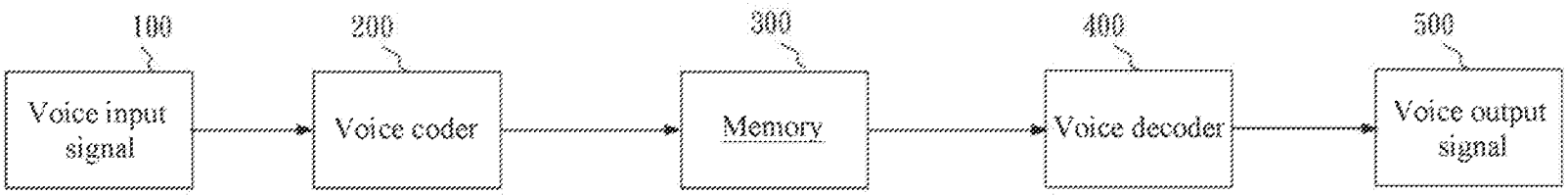
FIG. 1 (Prior Art)
FIG. 1 is a conventional voice coding and decoding system diagram (prior art)
Figure 2A:
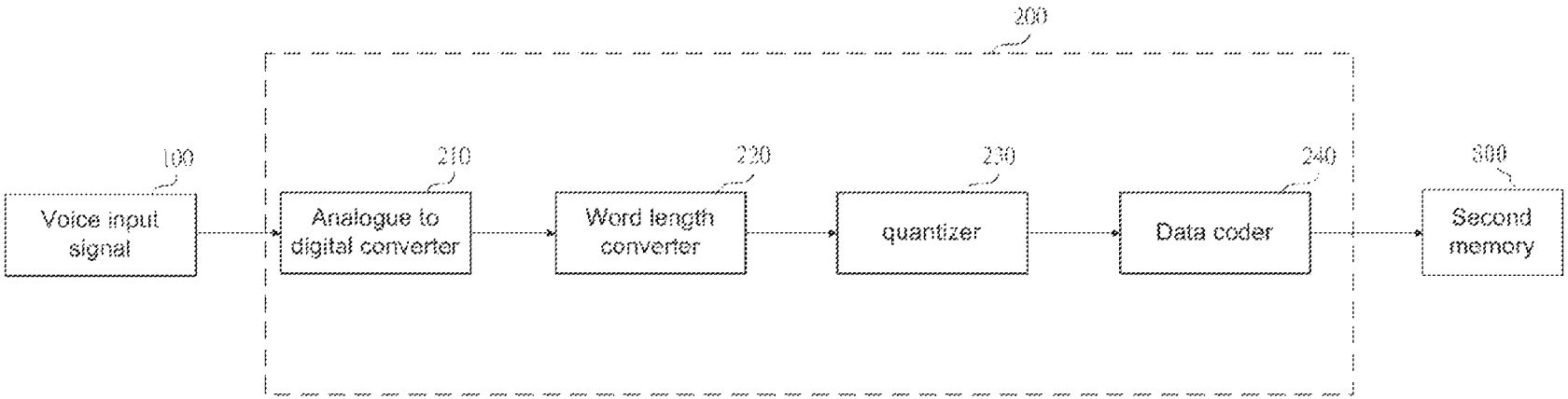
FIG. 2A (Prior Art)
FIG. 2A shows a first embodiment of a functional block diagram of a conventional voice coder (prior art)
Figure 2B:
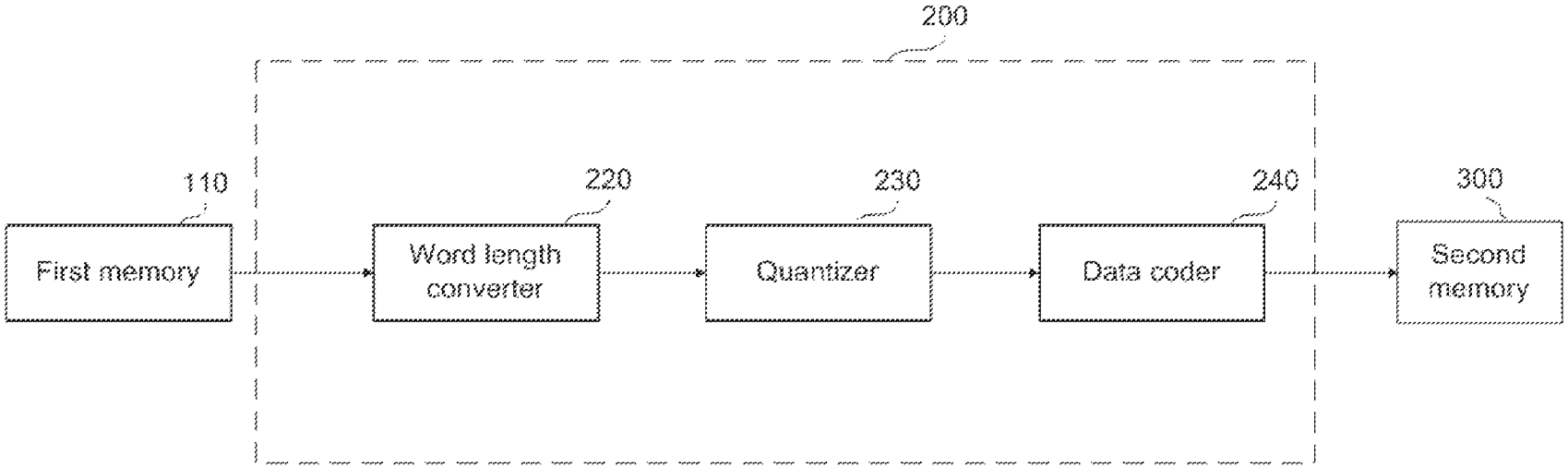
FIG. 2B (Prior Art)
FIG. 2B shows a second embodiment of a functional block diagram of a conventional voice coder (prior art)
Figure 3:
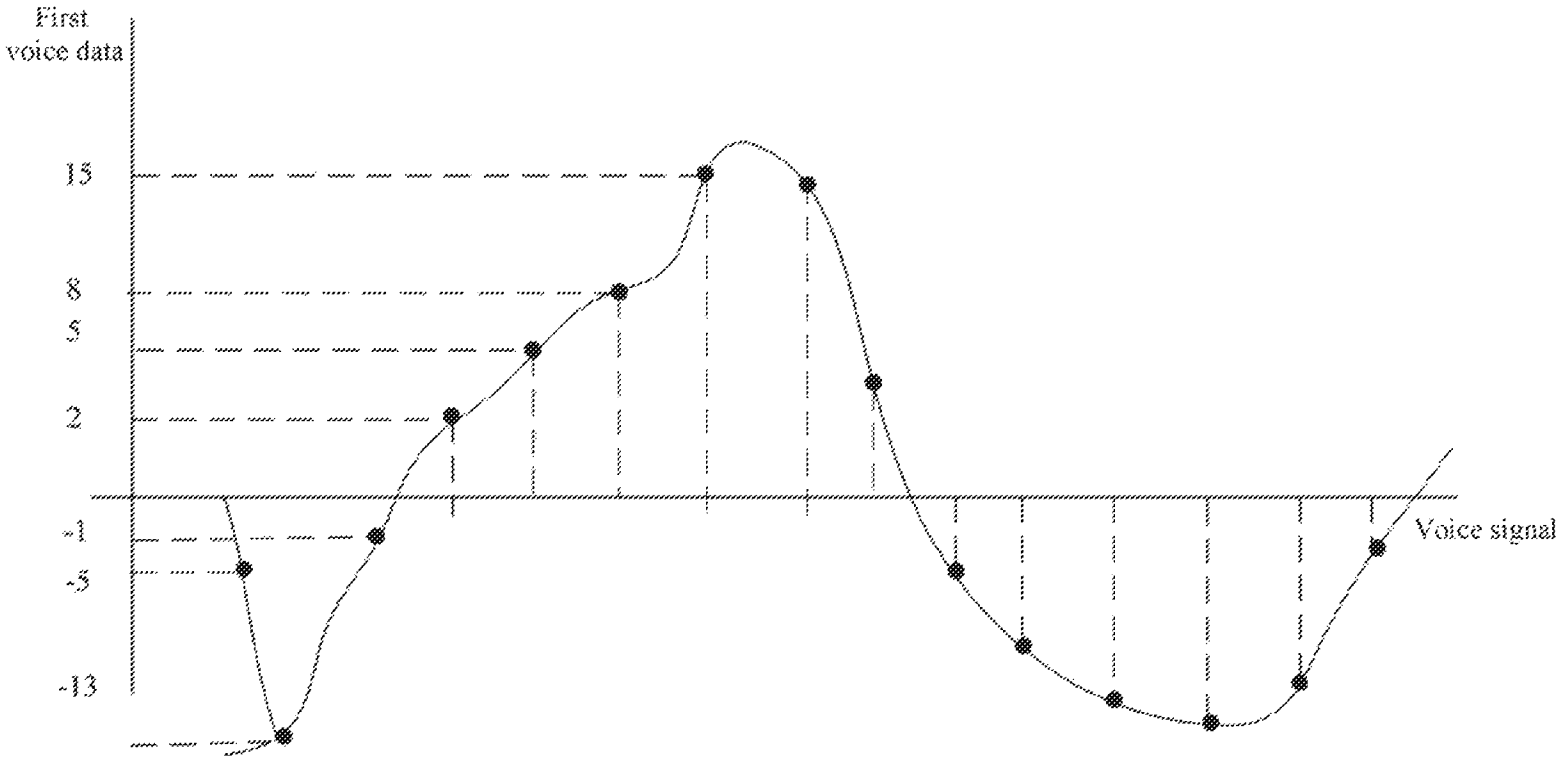
FIG. 3 (Prior Art)
FIG. 3 is a conventional analogue to digital sample diagram (prior art)
Figure 4:
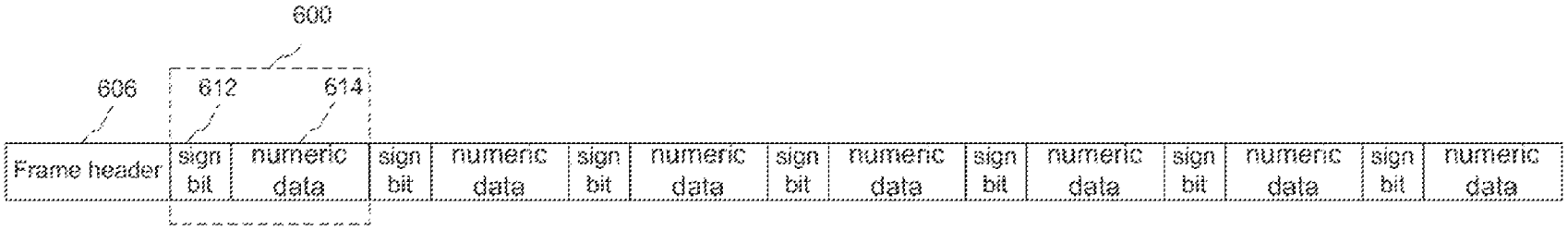
FIG. 4 (Prior Art)
FIG. 4 is a diagram of conventional tandem voice data (prior art)

When multiple quantization tables exist, the most suitable table may be determined according to the total quantization error of the data in each frame. Please refer to FIG. 3, in which multiple first voice data of two contiguous frames can be represented by the sequences (−6, −12, −1, 3, 5, 8, 15, 8, 5). It is assumed that a total of 8 tables may be used, after the computations of total quantization error for different quantization table, Table 2 and Table 3 are the most suitable tables for the (−6, −12, −1) sequence and the (3, 5, 8, 15, 8, 5) sequence. The selection of the suitable quantization table is well known by persons skilled in the art, and is not described.

Firstly, after the first zero-crossing condition is past, and (−6, −13, −1) is encountered, the negative sign bit 612 is obtained to be 1, then an absolute value is taken from the (−6, −13, −1), as (6, 13, 1), first the frame header 606 of Table 2 is set to be 000, then an index code may be obtained to be (4, 8, 1) after the best fit index search using Table 2, and finally the sequence is obtained to be (0100, 1000, 0001) corresponding to the binary numeric data of Table 2. Afterwards, the value 000 of the frame header 606, and the value 1 of the sign bit 612 are added. The finally encoded voice data frame 624 is (000, 1, 0100, 1000, 0001).

Secondly, after the second zero-crossing condition is past, the frame header 606 of Table 3 is firstly set to be 01, then (3, 5, 8, 15, 8, 5) is quantized using Table 3. The sign bit 612 being 0 represents a positive value, then the nearest table code is searched using Table 3, which is well known by persons skilled in the art, so as to obtain an index code (1, 2, 3, 5, 3, 2) and finally the code corresponding to the binary numeric data of Table 3 is (0001, 0010, 0011, 0101, 0011, 0010). Afterwards, the value 001 of the frame header 606 and the value 0 of the sign bit 612 are added, so as to obtain the encoded voice data frame 626 (001, 0, 0001, 0010, 0011, 0101, 0011, 0010).

Please refer to FIG. 7, in which the positive and the negative frame code data are combined, and a frame switching control code 1111 is added to obtain a complete voice data sequence stream (1111, 000, 1, 0100, 1000, 0001, 1111, 001, 0, 0001, 0010, 0011, 0101, 0011, 0010).

In the embodiment, one sign bit is added in an initial code, so as to omit the subsequent sign-bit with the positive and negative numeric data. The more the data points between two contiguous zero-crossing points, the greater the amount of omissible data.

From another point of view, quantization coding of 4-bit is taken as an example. In a quantization result after being coded through the prior art, each digital code of 4 bits includes one sign bit, and the effective magnitude data only has 3 bits. In the present disclosure, in the existing architecture of 4 bit, the original 4 bit is used as the magnitude data. In the application of the table look-up method, on the basis of the same data amount, the resolution of the voice signal coding is improved by near 100%, so as to greatly improve the quality of the voice signal coding.

TABLE 2

| Binary index codeword | Index codeword | Quantization table |
|---|---|---|
| 0000 | 0 | 0 |
| 0001 | 1 | 1 |
| 0010 | 2 | 2 |

TABLE 2-continued

| Binary index codeword | Index codeword | Quantization table |
|---|---|---|
| 0011 | 3 | 4 |
| 0100 | 4 | 6 |
| 0101 | 5 | 8 |
| 0110 | 6 | 9 |
| 0111 | 7 | 11 |
| 1000 | 8 | 12 |
| 1001 | 9 | 14 |
| 1010 | 10 | 16 |
| 1011 | 11 | 17 |
| 1100 | 12 | 19 |
| 1101 | 13 | 20 |
| 1110 | 14 | 22 |
| 1111 | 15 | Frame switch control code |

TABLE 3

| Binary index codeword | Index codeword | Quantization table |
|---|---|---|
| 0000 | 0 | 0 |
| 0001 | 1 | 3 |
| 0010 | 2 | 5 |
| 0011 | 3 | 8 |
| 0100 | 4 | 12 |
| 0101 | 5 | 15 |
| 0110 | 6 | 18 |
| 0111 | 7 | 22 |
| 1000 | 8 | 25 |
| 1001 | 9 | 28 |
| 1010 | 10 | 32 |
| 1011 | 11 | 35 |
| 1100 | 12 | 38 |
| 1101 | 13 | 42 |
| 1110 | 14 | 46 |
| 1111 | 15 | Frame switch control code |

Figure 8:
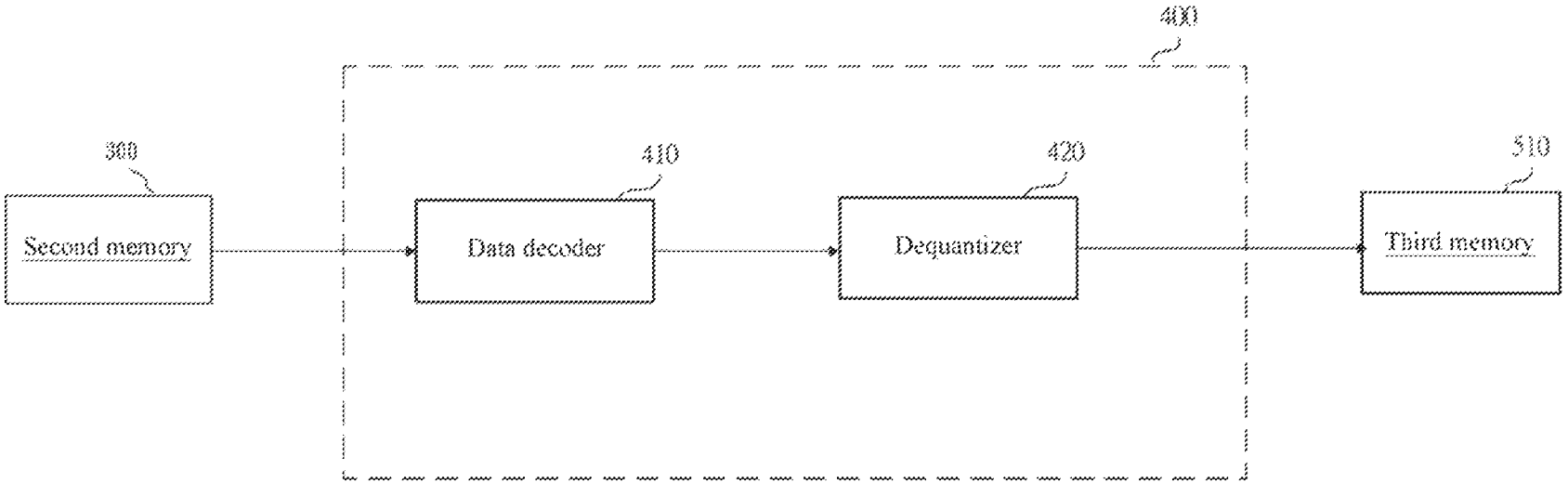
FIG. 8 is a functional block diagram of a voice decoder according to the present disclosure.

The above-mentioned is a part of the coding device. Please refer to FIG. 8, which describes an audio quantization decoding module according to the present disclosure, capable of decoding the encoder voice data stream in the present disclosure. The audio dequantization decoding module includes a data decoder 410 and a dequantizer 420. The data decoder 410 reads the second encoded data stream in the second memory 300 and performs decoding to generate a plurality of second decoded data stream, in which each second decoded data stream includes a second frame header, a second sign bit, and a plurality of second numeric data. The dequantizer 420 is connected to the data decoder, receives the second decoded data stream, dequantizes the second numeric data according to the quantization table indexed by the second frame header and the second sign bit to generate a plurality of second voice data in sequence, and stores the second voice data in a third memory 510.

Practically, the second memory 300 and the third memory 510 may be different blocks in the same memory.

For example: after the data decoder 410 performs decoding, the voice data sequence string (1111, 000, 1, 0100, 1000, 0001, 1111, 001, 0, 0001, 0010, 0011, 0101, 0011, 0010) of Example 1 may be obtained.

Next, the frame switch control code 1111 of the voice data sequence string is removed, then the dequantizer 420 takes Table 2 for the dequantization process, and takes the sign bit as 1, which represents that the subsequent numeric data is the negative value, then obtains the index code (4, 8, 1) of Table 2, then the dequantized data (6, 12, 1), is obtained. As the sign bit 612 being 1 represent the negative value, the obtained multiple voice data is (−6, −12, −1). Similarly, in the second sequence, the frame switch control code 1111 of the voice data sequence string is removed, 001 represents the second quantization table (Table 3), the sign bit 612 is 0, the index code is (2, 3, 4, 8, 4, 2), and Table 3 is correspondingly used to obtain the dequantized data (5, 8, 12, 25, 12, 5). Then the dequantizer outputs the multiple first voice data (−5, −12, −1, 5, 8, 12, 25, 12, 5). Finally, the multiple first voice data is stored in the third memory 510.

Figure 9:
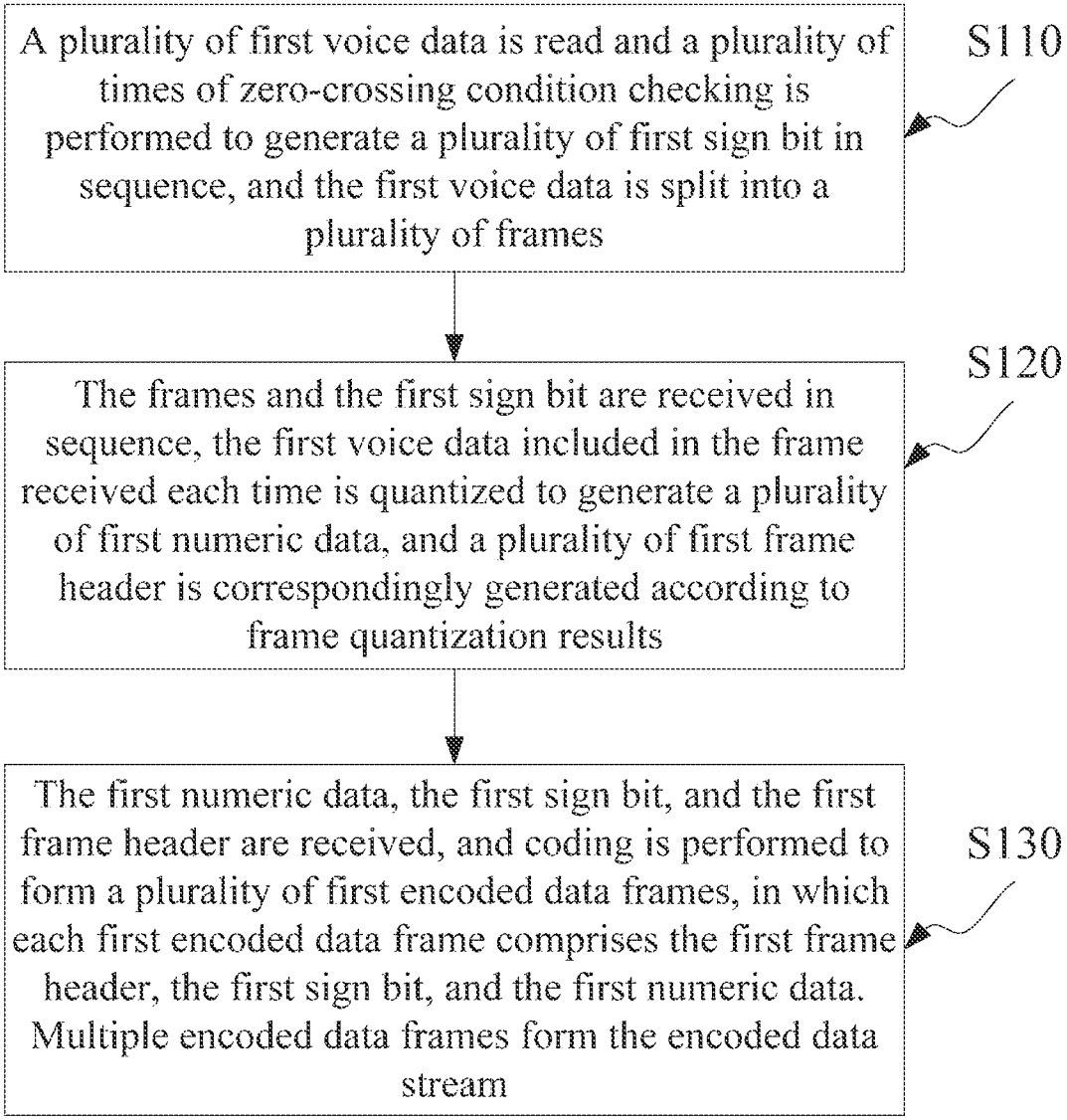
FIG. 9 is a flow chart of audio quantization coding according to the present disclosure.

Please refer to FIG. 9, which is a flow chart of audio quantization coding according to the present disclosure, which includes the following steps.

In Step 110, a plurality of first voice data is read and a plurality of times of zero-crossing condition checking is performed to generate a plurality of first sign bit in sequence, and the first voice data is split into a plurality of frames.

In Step 110, a word length reduction may be further performed on the first voice data.

In Step 120, the frames and the first sign bit are received in sequence, the first voice data included in the frame received each time is quantized to generate a plurality of first numeric data, and a plurality of first frame header is correspondingly generated according to frame quantization results.

In Step 130, the first numeric data, the first sign bit, and the first frame header are received, and coding is performed to form a plurality of first encoded data frames, in which each first encoded data frame includes the first frame header, the first sign bit, and the first numeric data. Multiple encoded data frames form the encoded data stream.

Zero-crossing condition calculation can be performed by multiplying two contiguous first voice data, when a product obtained after the two contiguous first voice data is a negative value, it represents that the zero-crossing condition is true.

Figure 10:
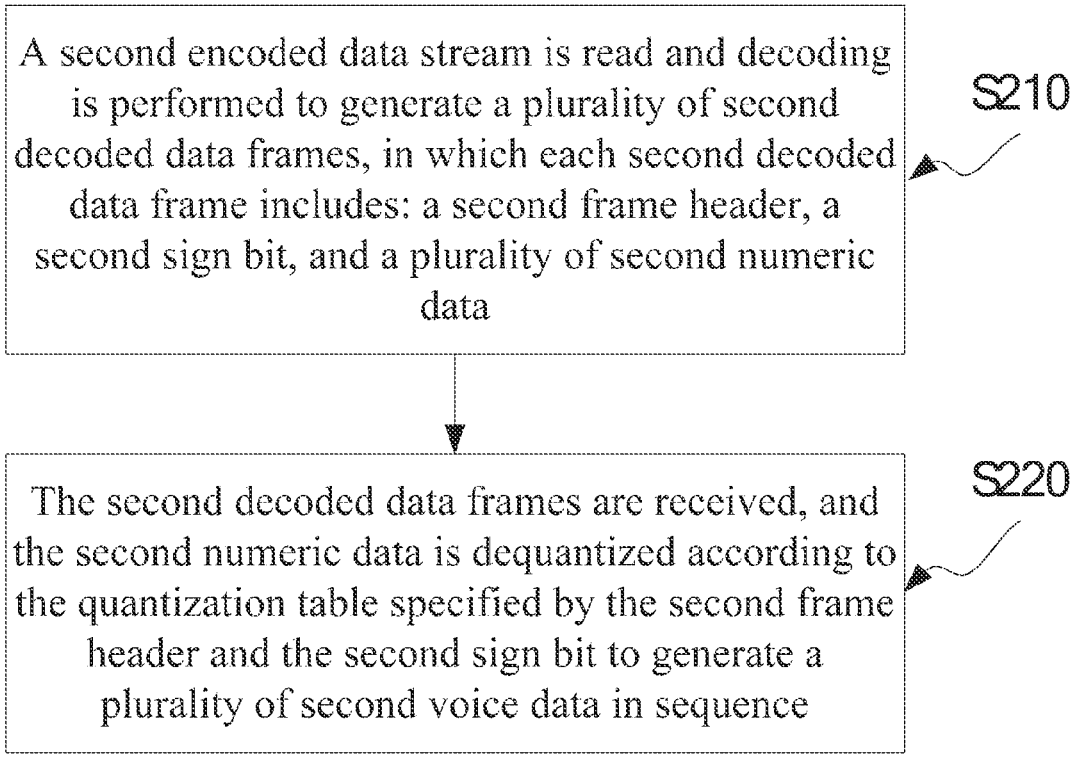
FIG. 10 is a flow chart of audio quantization decoding according to the present disclosure.

Please refer to FIG. 10, which is a flow chart of audio dequantization decoding according to the present disclosure, which includes the following steps.

In Step 210, a second encoded data stream is read and decoding is performed to generate a plurality of second decoded data frames, in which each second decoded data frame includes: a second frame header, a second sign bit, and a plurality of second numeric data.

In Step 220, the second decoded data frames are received, and the second numeric data is dequantized according to the quantization table specified by the second frame header and the second sign bit to generate a plurality of second voice data in sequence.

Figure 11:
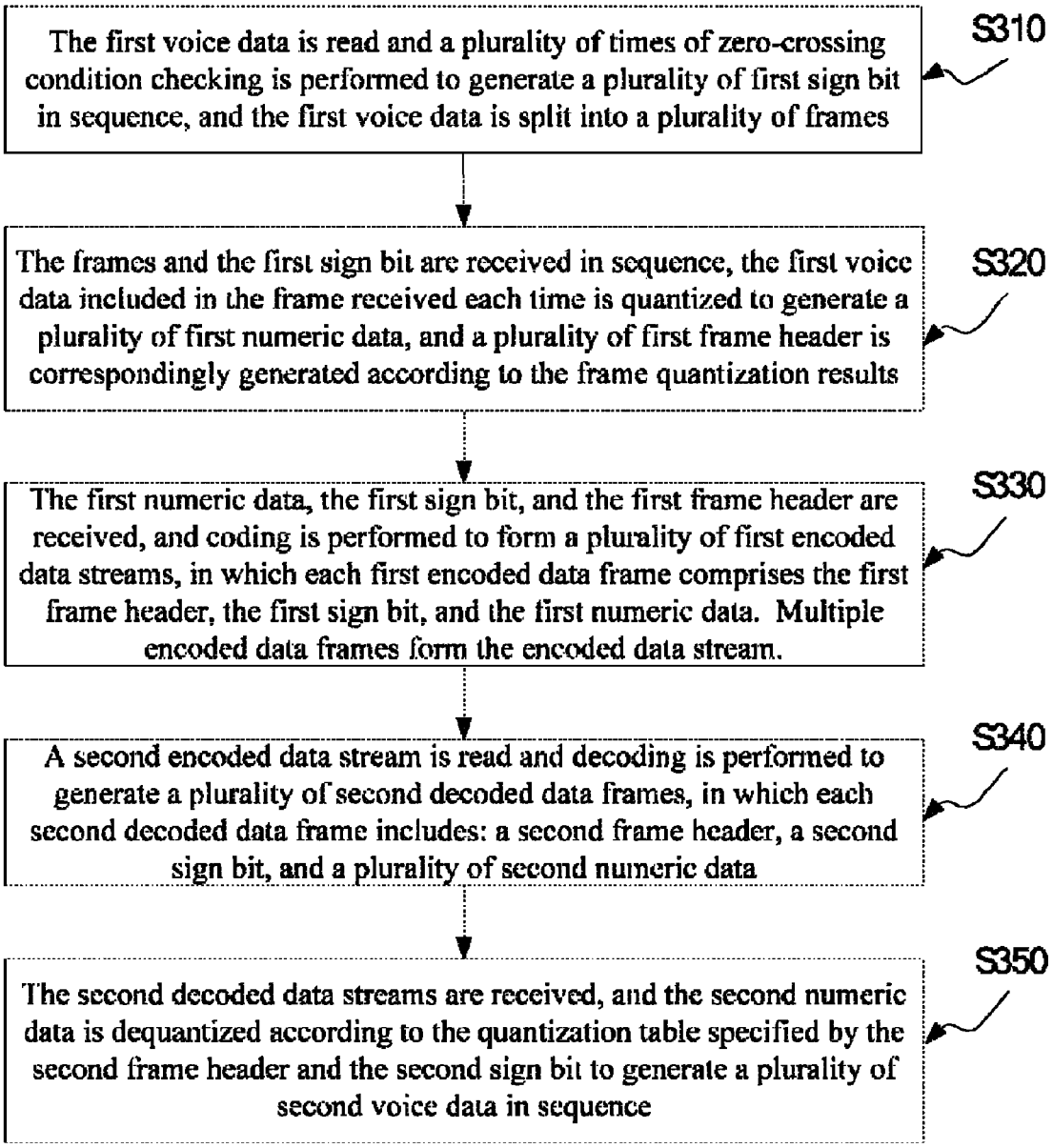
FIG. 11 is a flow chart of audio quantization coding and decoding according to the present disclosure.

Please refer to FIG. 11, which is a flow chart of audio quantization coding and decoding according to the present disclosure, which includes the following steps.

In Step 310, the first voice data is read and a plurality of times of zero-crossing condition checking is performed to generate a plurality of first sign bit in sequence, and the first voice data is split into a plurality of frames.

In Step 310, a word length reduction may be further performed on the first voice data.

In Step 320, the frames and the first sign bit are received in sequence, the first voice data included in the frame received each time is quantized to generate a plurality of first numeric data, and a plurality of first frame header is correspondingly generated according to the frame quantization results.

In Step 330, the first numeric data, the first sign bit, and the first frame header are received, and coding is performed to form a plurality of first encoded data streams, in which each first encoded data frame includes the first frame header, the first sign bit, and the first numeric data. Multiple encoded data frames form the encoded data stream.

In Step 340, a second encoded data stream is read and decoding is performed to generate a plurality of second decoded data frames, in which each second decoded data frame includes: a second frame header, a second sign bit, and a plurality of second numeric data.

In Step 350, the second decoded data streams are received, and the second numeric data is dequantized according to the quantization table specified by the second frame header and the second sign bit to generate a plurality of second voice data in sequence.

The first numeric data and the first frame header are generated by performing table look-up through the first voice data by using one or more quantization table. The second voice data is generated by performing table look-up through the second frame header, the second sign bit, and the second numeric data by using one or more quantization tables. Zero-crossing condition checking is performed by multiplying two contiguous first voice data, when a product obtained after the two contiguous first voice data is a negative value, it is determined that the zero-crossing condition is true. The first sign bit and the second sign bit represent a positive value or a negative value.

Figure 12A:
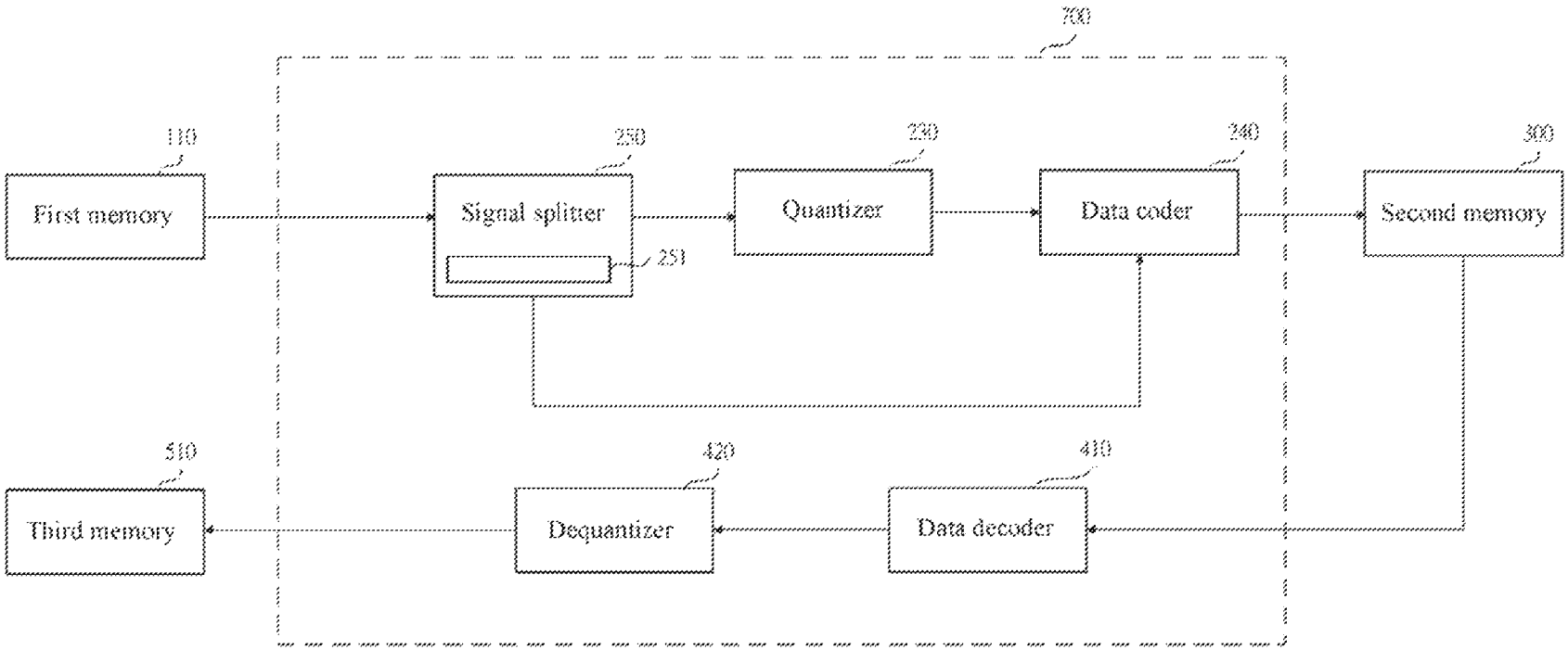
FIG. 12A shows a first embodiment of a functional block diagram of a voice coding and decoding device according to the present disclosure.
Figure 12B:
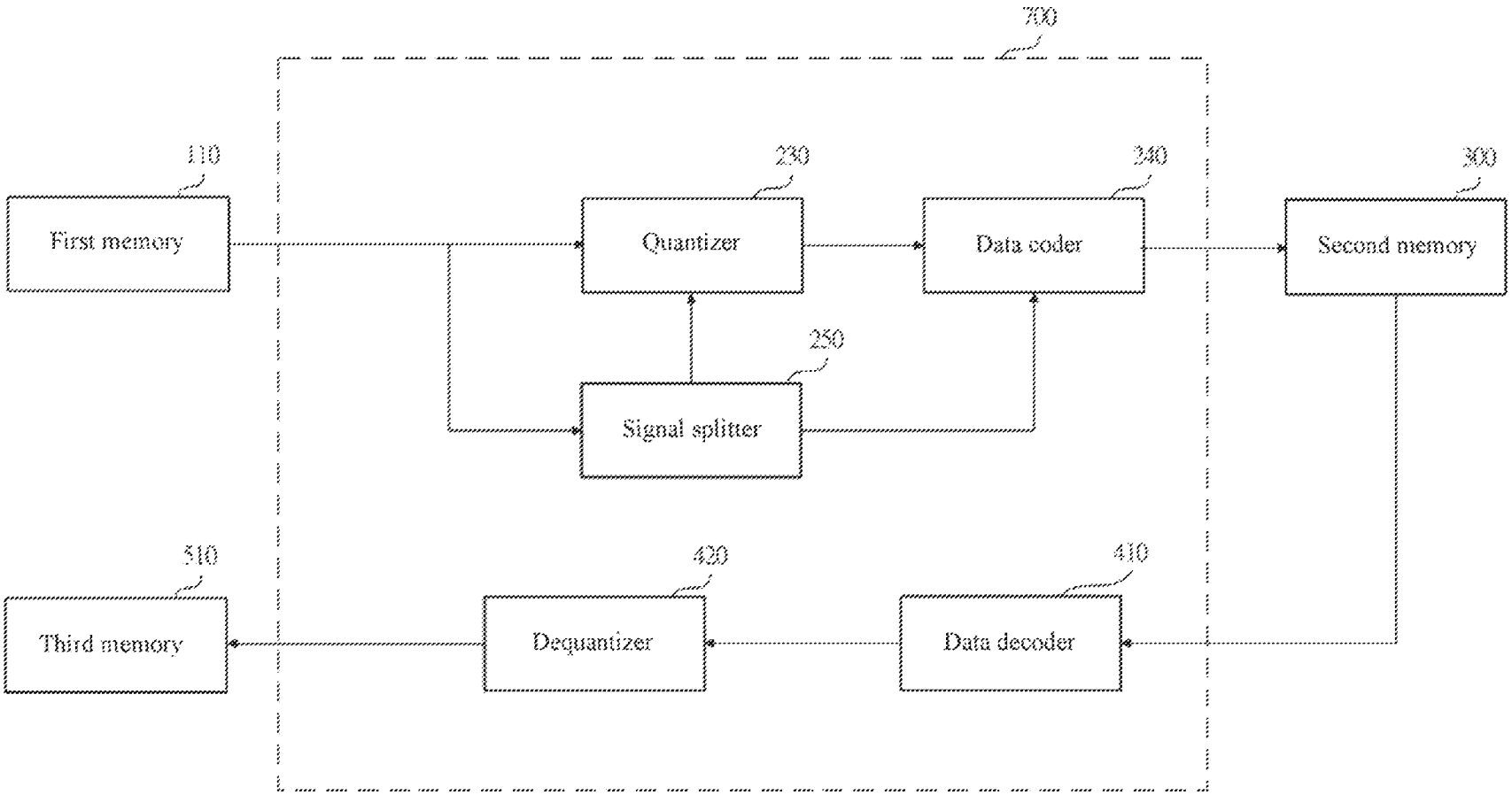
FIG. 12B shows a second embodiment of a functional block diagram of a voice coding and decoding device according to the present disclosure.

Please refer to views of a voice coding and decoding system according to the present disclosure, as shown in FIG. 12A and FIG. 12B; embodiments of using the coding and decoding device of the voice coder of FIG. 5A and FIG. 5B are shown. Considering the embodiments of FIG. 12A and FIG. 12B together, the audio quantization coding and decoding device use memories (including a first memory 110, a second memory 300, and a third memory 510), to perform signal coding and decoding, the first memory 110 records a plurality of first voice data, and the second memory 300 records a second encoded data stream. The coding and decoding device includes: a signal splitter 250, a quantizer 230, a data coder 240, a data decoder 410, and a dequantizer 420.

The signal splitter 250 reads multiple first voice data and performs a plurality of times of zero-crossing condition checking to generate a plurality of first sign bit in sequence, and splits the first voice data into a plurality of frames. The quantizer 230 is connected to the signal splitter, receives the multiple first voice data and the first sign bit corresponding to each frame, quantizes the multiple first voice data corresponding to the frame received each time to generate a plurality of first numeric data, and correspondingly generates a first frame header according to a frame quantization result. The data coder 240 is connected to the quantizer 230 and the signal splitter 250, receives the first numeric data, the first sign bit, and the first frame header generated by the quantizer 230 for each frame, and performs coding to form a first encoded data stream. The data decoder 410 is connected to the second memory 300, reads the second encoded data stream and performs decoding to generate a plurality of second decoded data frames. Each second decoded data frame includes a second frame header, a second sign bit, and a plurality of second numeric data. The dequantizer 420 is connected to the data decoder 410, receives the second decoded data stream, dequantizes the second numeric data according to values of the second frame header and the second sign bit to generate a plurality of second voice data in sequence, and stores the second voice data to the third memory 510.

Practically, the first memory 110, the second memory 300, and the third memory 510 may be different blocks in the same memory.

While the present disclosure has been described by the way of example and in terms of the preferred embodiments, it is to be understood that the disclosure need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An audio quantization coding device, wherein a memory is used to perform signal coding, and the memory records a plurality of first voice data, the device comprising:

the memory;

a signal splitter connected to the memory, reading the plurality of first voice data and performing a plurality of times of zero-crossing condition checking to generate a plurality of first sign bit in sequence, and splitting the plurality of first voice data into a plurality of frames according to signal polarity so that the plurality of first voice data within the same frame have the same sign bit;

a quantizer, connected to the signal splitter, calculating the total quantization error of all the first voice data corresponding to the received frame, receiving the plurality of first voice data and the first sign bit corresponding to each frame, quantizing the plurality of first voice data corresponding to the frame received each time to generate a plurality of first numeric data, and correspondingly generating a first frame header according to a frame quantization result; and a data coder, connected to the quantizer and the signal splitter, receiving the plurality of first numeric data, the first sign bit, and the first frame header generated by the quantizer for each frame, and performing coding to form a first encoded data stream, wherein the data coder operates in real time.

2. The audio quantization coding device according to claim 1, further comprising:

a word length converter, connected between the memory and the signal splitter or connected among the memory, the signal splitter, and the quantizer, the word length converter performing word length reduction on the plurality of first voice data.

3. The audio quantization coding device according to claim 1, wherein the first encoded data stream is corresponding to the frame that comprises the first frame header, the first sign bit, and the plurality of first numeric data corresponding to the frame.

4. The audio quantization coding device according to claim 1, wherein the plurality of first voice data corresponding to the frame is read from the memory.

5. The audio quantization coding device according to claim 1, wherein the signal splitter comprises a register, the register is used for storing the plurality of first voice data corresponding to the frame, and the plurality of first voice data corresponding to the frame is read from the register of the signal splitter.

6. The audio quantization coding device according to claim 1, wherein the quantizer using one or more quantization tables for performing table look-up and quantization error calculation for each frame of first voice data to obtain an optimal quantization table index corresponding to a minimum quantization error, and correspondingly obtains the plurality of first numeric data according to the optimal quantization table.

7. An audio quantization decoding device, wherein a memory is used as a storage medium to perform signal decoding, the memory records a second encoded data stream, the device comprising:

a data decoder, connected to the memory, reading the second encoded data stream and performing decoding to generate a plurality of second decoded data frames, wherein each second decoded data frame comprises a second frame header, a second sign bit, and a plurality of second numeric data; and a dequantizer, connected to the data decoder, receiving the second decoded data stream, and dequantizing the plurality of second numeric data according to values of the second frame header and the second sign bit to generate a plurality of second voice data in sequence.

8. The audio quantization decoding device according to claim 7, wherein the dequantizer correspondingly obtains the plurality of second voice data by using one or more quantization tables for performing table look-up dequantization through the second frame header, the second sign bit, and the plurality of second numeric data comprised in each decoded data stream.

9. An audio quantization coding method, comprising:

reading a plurality of first voice data and performing a plurality of times of zero-crossing condition checking to generate a plurality of first sign bit in sequence, and splitting the plurality of first voice data into a plurality of frames according to signal polarity so that the plurality of first voice data within the same frame have the same sign bit;

receiving the plurality of first voice data and the first sign bit corresponding to each frame, calculating the total quantization error of all the first voice data corresponding to the received frame, quantizing the plurality of first voice data corresponding to the frame received each time to generate a plurality of first numeric data, and correspondingly generating a first frame header according to a frame quantization result; and receiving the plurality of first numeric data, the first sign bit, and the first frame header generated corresponding to each frame, and performing coding to form a first encoded data stream, wherein the above coding steps are performed by an audio quantization coding device in real time.

10. The audio quantization coding method according to claim 9, wherein the first encoded data stream is corresponding to the frame and comprises the first frame header, the first sign bit, and the plurality of first numeric data corresponding to the frame.

11. The audio quantization coding method according to claim 9, further comprising:

performing the word length reduction on the plurality of first voice data.

12. The audio quantization coding method according to claim 9, wherein the numeric data and the frame header are generated by using one or more quantization tables for performing table look-up through the plurality of first voice data.

13. The audio quantization coding method according to claim 9, wherein in the zero-crossing condition checking, two contiguous first voice data are multiplied, and a product being negative value indicates the zero-crossing condition.

14. An audio quantization decoding method, comprising:

reading a second encoded data stream and performing decoding to generate a plurality of second decoded data frames, wherein each second decoded data frame comprises: a second frame header, a second sign bit, and a plurality of second numeric data, wherein the plurality of second numeric data within the same second decoded data frame have the same sign bit; and receiving the second decoded data stream, and dequantizing the plurality of second numeric data according to values of the second frame header and the second sign bit to generate a plurality of second voice data in sequence, wherein the plurality of second voice data are generated by an audio quantization decoding device in real time.

15. The audio quantization decoding method according to claim 14, wherein the plurality of second voice data is generated by using one or more quantization tables for performing table look-up of quantization table specified by the frame header, the sign bit, and the numeric data.

16. An audio quantization coding and decoding method, comprising:

reading a plurality of first voice data and performing a plurality of times of zero-crossing condition checking to generate a plurality of first sign bit in sequence, and splitting the first voice data into a plurality of frames according to signal polarity so that the plurality of first voice data within the same frame have the same sign bit;

receiving the plurality of first voice data and the first sign bit corresponding to each frame, calculating the total quantization error of all the first voice data corresponding to the received frame, quantizing the plurality of first voice data corresponding to the frame received each time to generate a plurality of first numeric data, and correspondingly generating a first frame header according to a frame quantization result;

receiving the plurality of first numeric data, the first sign bit, and the first frame header generated by the quantizer for each frame, and performing coding to form a first encoded data stream;

reading a second encoded data stream and performing decoding to generate a plurality of second decoded data streams, wherein each second decoded data stream comprises a second frame header, a second sign bit, and a plurality of second numeric data; and receiving the plurality of second decoded data stream, and dequantizing the plurality of second numeric data according to values of the second frame header and the second sign bit to generate a plurality of second voice data in sequence, wherein the plurality of second voice data are generated by an audio quantization coding and decoding device in real time.

17. The audio quantization coding and decoding method according to claim 16, wherein the first encoded data stream is corresponding to the frame and comprises the first frame header, the first sign bit, and the plurality of first numeric data corresponding to the frame.

18. The audio quantization coding and decoding method according to claim 16, further comprising: performing word length reduction on the plurality of first digital voice data.

19. The audio quantization coding and decoding method according to claim 16, wherein the plurality of first numeric data and the first frame header are obtained by using one or more quantization tables for performing table look-up and quantization error calculation for each frame of first voice data to obtain an optimal quantization table index corresponding to a minimum quantization error, and correspondingly obtains the plurality of first numeric data according to the optimal quantization table.

* * * * *